United States Patent [19]

Constapel

[11] 4,439,065

[45] Mar. 27, 1984

[54] CONTINUOUS GALLERY CONSTRUCTION, IN PARTICULAR FOR UNDERGROUND MINE TUNNELS

[76] Inventor: Artur Constapel, Wilhelmstrasse 140, 4100 Duisburg 17, Fed. Rep. of Germany

[21] Appl. No.: 297,602

[22] Filed: Aug. 31, 1981

[30] Foreign Application Priority Data

Aug. 29, 1980 [DE] Fed. Rep. of Germany ..... 3032521

[51] Int. Cl.[3] ..... E21D 11/22

[52] U.S. Cl. ..... 405/151; 405/132; 405/150; 138/173

[58] Field of Search ..... 405/150, 151, 152, 153, 405/124, 126; 285/114, 226; 138/121, 173, 177

[56] References Cited

U.S. PATENT DOCUMENTS

| | | | |
|---|---|---|---|
| 2,286,197 | 6/1942 | Claybaugh | 405/124 X |
| 2,536,758 | 1/1951 | Macleod | 405/124 X |
| 3,097,494 | 7/1963 | Chapron | 405/153 |
| 4,252,464 | 2/1981 | Habib | 405/153 |

FOREIGN PATENT DOCUMENTS

| | | | |
|---|---|---|---|
| 2840174 | 3/1980 | Fed. Rep. of Germany | 138/121 |
| 8001611 | 10/1981 | Netherlands | 138/121 |

*Primary Examiner*—Dennis L. Taylor

*Attorney, Agent, or Firm*—Pollock, Vande Sande & Priddy

[57] ABSTRACT

Thin, sheet metal elements with longitudinally arranged corrugations are used for a gallery construction. The cross-sectional form of the thin, metal sheets is wavy. The construction elements are easy to handle, and can be quickly assembled to provide a provisional gallery. Final assembly with anchoring stays or with supporting arches can subsequently take place under the protection of the provisional construction.

11 Claims, 7 Drawing Figures

CONTINUOUS GALLERY CONSTRUCTION, IN PARTICULAR FOR UNDERGROUND MINE TUNNELS

Figure 1:
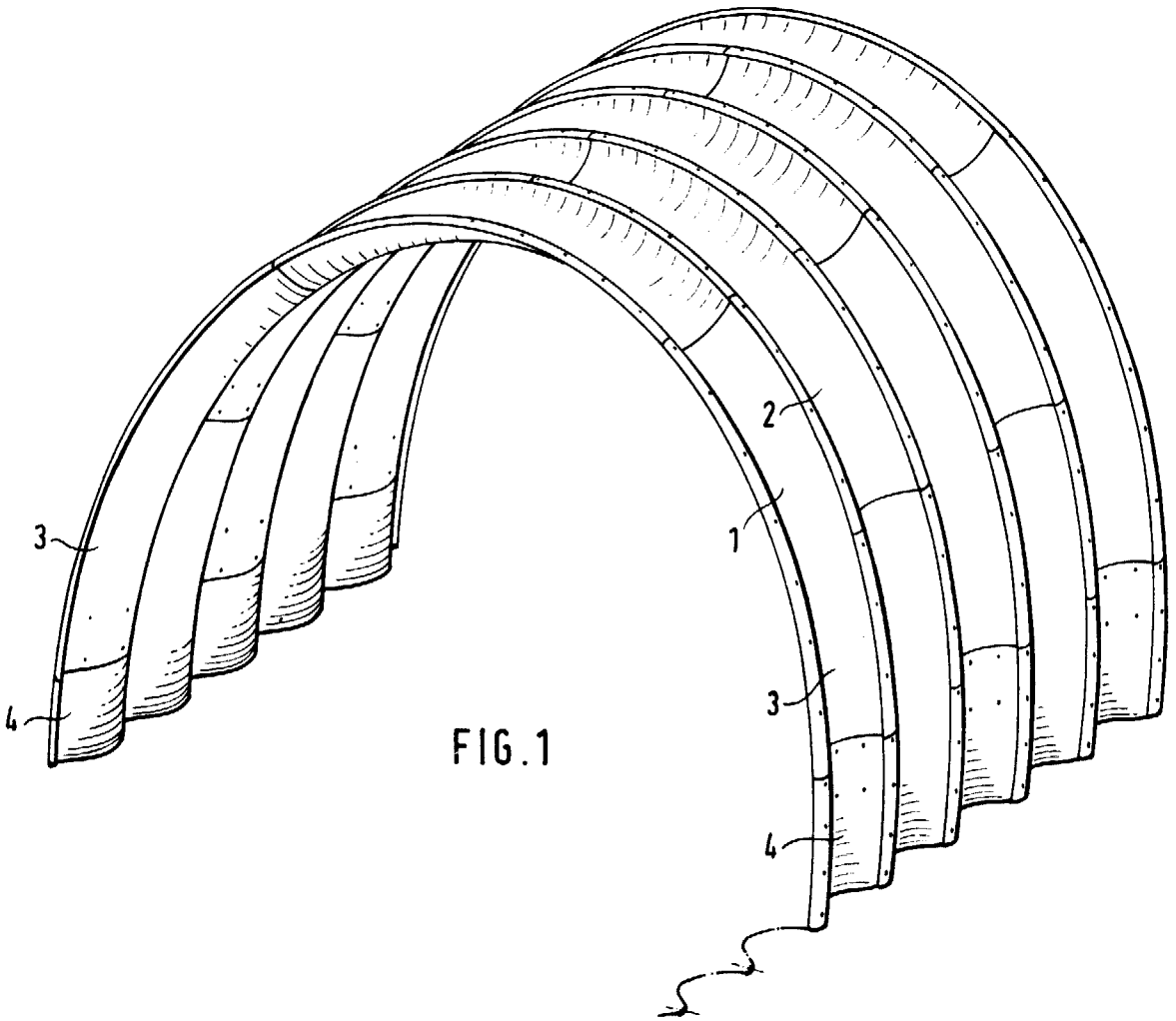

The invention relates to a continuous gallery construction, in particular for underground mine tunnels, and consists of a longitudinally arranged series of multi-section construction elements, made from sheet steel and having at least one section at each side and at least one roof section over the top, whereby the construction elements have an externally concave channel form with convex ridges which overlap the ridges of the neighbouring construction elements.

In a known gallery construction of this type(Publication "Glückauf" 110, 1974, No. 13, page 508), the construction elements consist of thick steel sheets with angular channels. The thick-walled construction elements are self-supporting. Neither supporting arches nor rock anchors are required for the finished gallery.

Because of their weight, the known construction elements are relatively time-consuming and difficult to assemble. Considerable assembly times result, during which the workers are largely unprotected against falling rock.

All other known construction methods for underground galleries also have the disadvantage that installation of the gallery is relatively time-consuming and that the workers are largely unprotected against falling rock during assembly. This is true both for construction with supporting arches and with rock anchors.

The purpose of the invention is to obviate the disadvantages of the known gallery devices and methods, and to provide a continuous gallery construction which can be particularly quickly and easily assembled, and which affords a substantial protection against falling rock after an initial phase of assembly.

This purpose is achieved according to the invention in that the construction elements, carried by anchoring stays or by supporting arches, have a shape which, in cross-section taken longitudinally in relation to the gallery, is wavy and wherein the amplitude, the width and where applicable the radius of curvature of the channels are substantially greater than the amplitude, the width and where applicable the the radius of curvature of the ridges which overlap neighbouring ridges, the construction elements being provided with longitudinally orientated corrugations relative to the gallery and the sheet thickness of the elements being between 0.5 and 3 mm.

The gallery construction according to the invention is distinguished by the fact that it is possible to assemble a provisional gallery in a very short time because the elements can quickly be assembled to provide a stable structure whose final bearing capacity is achieved in a second construction phase during which rock anchors are located or supporting arches erected. Thus, preliminary protection is already provided in the initial phase of construction in which the elements are connected to form a supporting structure which shields those working below from falling rock. For the initial construction, it is sufficient to lap the edges of the element over the edges of the preceding gallery element. On final assembly with supporting arches, these are simply inserted into the concave inner flank of the edge zones. In the case of a construction with anchoring stays, the bores for these can be made in the rock through holes provided in the gallery construction elements. During the boring operation loose rock can slide down the external surface of the elements without seriously endangering the workers.

Despite the thinness of the construction elements, which makes them individually light and easy to handle, the provision of the aforementioned longitudinal corrugations together with chosen cross-sectional form ensures a comparatively high stability such as is sufficient for a provisional structure. The free space between the gallery construction elements and the walls of the tunnel can be filled with any of the usual filling materials. For example, a filling with anhydride can take place whereby the construction elements act as metal dead-moulds.

Figure 2:
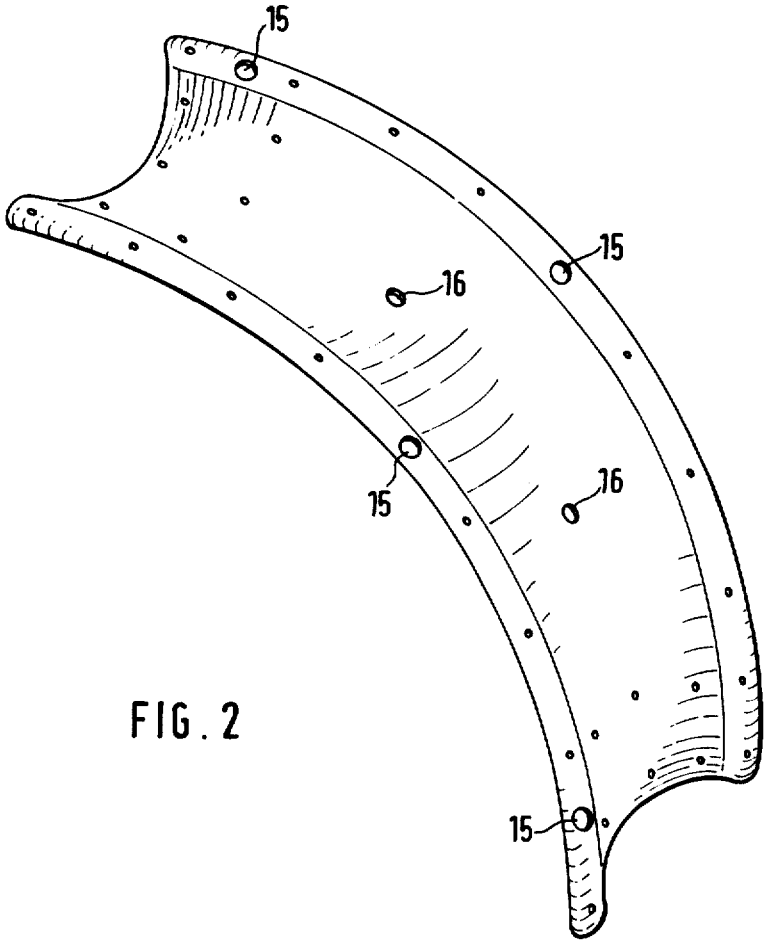
Figure 3:
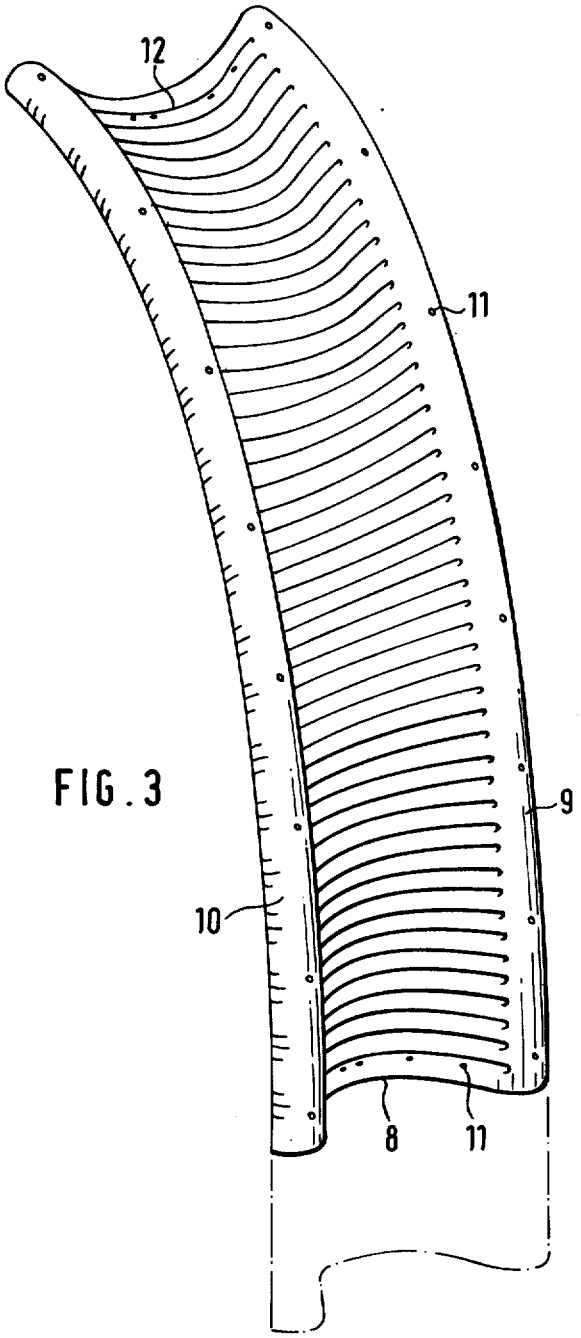
Figure 4:
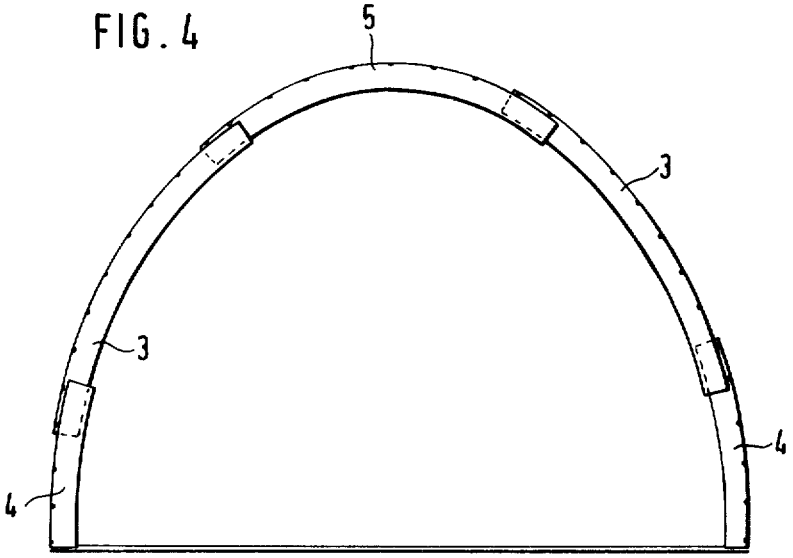
Figure 5:
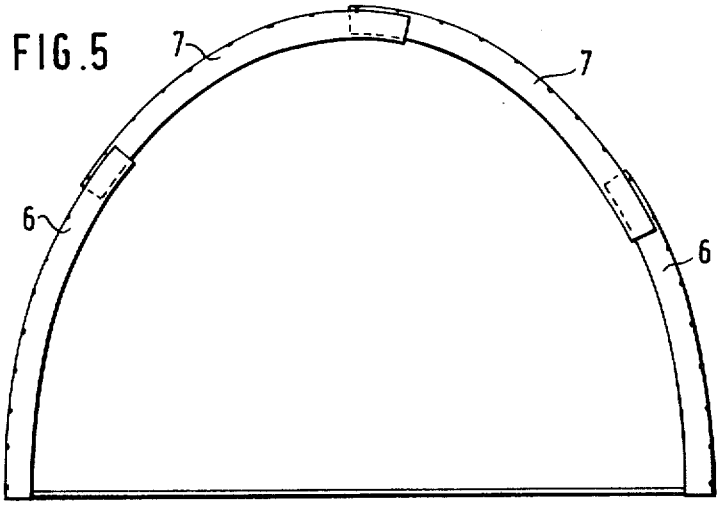
Figure 6:
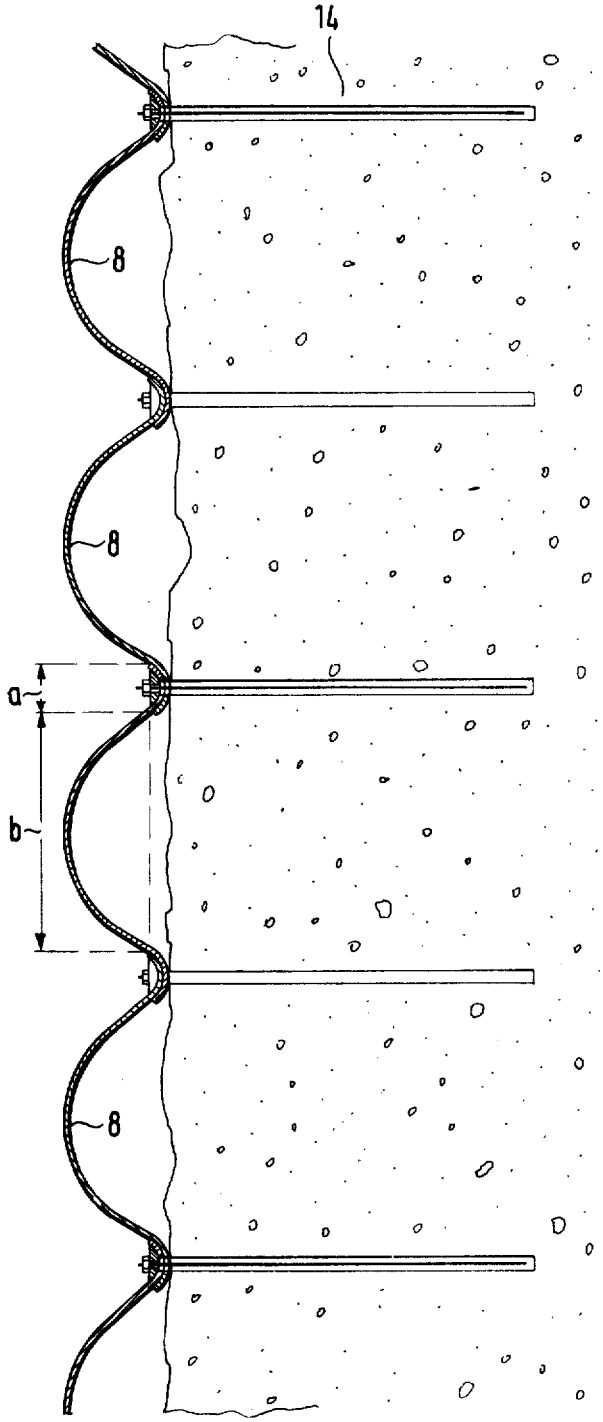
Figure 7:
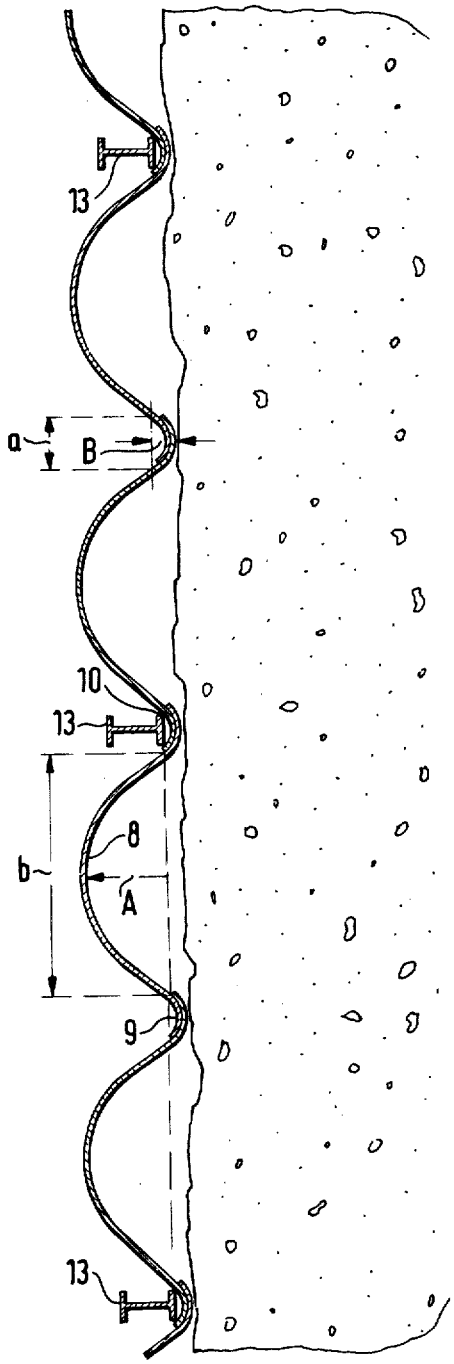

Further characteristics of the invention will become apparant from and the following description in which a preferred reference to the accompanying drawings wherein:

FIG. 1 is a perspective view of a gallery construction framework with several elements arranged in series, FIG. 2 depicts a single construction-element, FIG. 3 depicts a construction element with a longitudinally oriented corrugation, FIG. 4 is a diagrammatic representation of the face of a gallery framework, FIG. 5 is a representation according to FIG. 4 of another gallery framework, FIG. 6 is a longitudinal cross-section through a construction with anchoring stays, and FIG. 7 is a longitudinal cross-section analogous to FIG. 6 with supporting arches.

Various construction elements are joined together to form a framework 1 or 2. In FIGS. 1 and 4, the framework 1 consists of two side-wall elements 3 and 4 provided at each side of the tunnel and a roof element 5 over the top. As shown in FIGS. 1 and 5, the neighbouring framework 2 has two side-wall elements 6 adjoining two roof elements 7 which meet at the highest point.

In the cross-section drawings, FIGS. 6 and 7, the shape of the individual construction elements can be clearly seen. The elements have a channel form with an externally concave, and thus internally convex channel 8. The channel 8 has a width b. Two externally convex ridge zones 9 and 10 are at each side of the channel 8. The construction elements have a wavy cross-sectional form longitudinally in relation to the tunnel. The amplitude A, the width b and the continuously varying radius of each channel are substantially greater than the amplitude B, the width a and the continuously varying radius of the ridge zones 9 and 10.

Holes are provided in the ridge zones and at each end of the construction elements, which serve to receive connecting elements. The connecting elements, for example screws, are fitted through the aligned holes of overlapping construction elements to secure neighbouring elements in their arch direction and throughout the gallery.

FIG. 3 shows the corrugations 12 which are longitudinally oriented in relation to the gallery.

In the embodiment according to FIG. 7, supporting arches 13 are provided which may be of any suitable structural section desired, and which are bent to a form corresponding to the internal contour of the gallery.

In the embodiment according to FIG. 6, the thin sheet-steel construction framework is anchored by means of anchor stays 14. The holes 15 for the anchor stays 14, which are provided in the ridge zones 8 and 9, can be clearly seen in FIG. 2.

Also in FIG. 2, holes 16 situated in the center of the channel can be seen, which can be used for filling concrete or anhydride behind the construction. The filling material is injected into the space between the tunnel wall and the external surface of the gallery frame work.

The width of the construction elements is between 30 and 120 cm. The width of the channel 8 thereby, is between 20 and 110 cm. A practical width a for the ridge zones 9 and 10 has proved to be a practical between 5 and 20 cm.

The spacing between the corrugations 12 is within a range of 2 to 5 cm. The thickness of the construction elements is between 0.5 and 3 mm. The ratio of the channel 8 width b to the ridge zone 9 and 10 width a ranges from 3:1 to 8:1.

I claim:

1. In a multi-section gallery construction for use in a mine tunnel, said gallery construction being of the type comprising a plurality of sheet steel elements disposed in partially overlapping relation to one another to provide a continuous longitudinally extending gallery in the mine tunnel, the improvement wherein each of said steel elements has a thickness in the range of 0.5 to 3 mm, each said element being of elongated arcuate shape and defining a plurality of spaced corrugations which are oriented in the longitudinal direction of said gallery, each said element having a cross-sectional shape in the longitudinal direction of said gallery consisting of a smoothly curved convex section the opposing edges of which merge into smoothly curved concave sections, the radii of curvature of said concave sections being substantially less than the radius of curvature of said convex section, adjacent ones of said steel elements overlapping one another in the longitudinal direction of said gallery only at said concave sections whereby said gallery exhibits a longitudinal cross section of smoothly curved wavy configuration consisting of plural convex sections and intervening smaller-radii concave sections, the amplitude (A) and longitudinal width (b) of each said concave section being substantially greater than the amplitude (B) and longitudinal width (a) of each said convex section, and supporting means in separable engagement with at least some of said overlapping concave sections for securing said gallery to a wall of the mine tunnel.

2. The structure of claim 1 wherein said supporting means comprise supporting arches which are in surface engagement with said overlapping concave sections.

3. The structure of claim 1 wherein said supporting means comprise anchoring stays, said overlapping concave sections being provided with holes for receiving said stays.

4. The structure of claim 1 including fastening means for attaching said overlapping elongated arcuate elements to one another, each of said elements being provided with holes at its opposing ends and along its opposing elongated edges for the reception of said fastening means.

5. The structure of claim 4 wherein said fastening means are screws.

6. The structure of claim 1 wherein the width of each of said elongated arcuate elements is between 30 and 120 cm.

7. The structure of claim 1 or claim 6 wherein the longitudinal width (b) of each concave section is between 20 and 110 cm.

8. The structure of claim 1 wherein the longitudinal width (a) of each convex section is between 5 and 20 cm.

9. The structure of claim 1 wherein the spacing between said corrugations is in the range of 2 to 5 cm.

10. The structure of claim 1 wherein the ratio of the width (b) of said concave section to the width (a) of a convex section is between 3:1 and 8:1.

11. The structure of claim 1 wherein at least some of said convex sections are provided with a plurality of holes for use in injecting a filler material into the region between said longitudinally extending gallery and the wall of the mine tunnel on which said gallery is supported.

* * * * *